United States Patent [19]

Wiley

[11] Patent Number: 4,850,740

[45] Date of Patent: Jul. 25, 1989

[54] METHOD AND APPARATUS FOR PREPARING ASPHALTIC PAVEMENT FOR REPAVING

[76] Inventor: Patrick C. Wiley, #303, 35 - 2nd Ave. S., Williams Lake, B.C., Canada, V2G 3W3

[21] Appl. No.: 202,135

[22] Filed: Jun. 2, 1988

[51] Int. Cl.[4] ..... E01C 23/14

[52] U.S. Cl. ..... 404/79; 404/90; 404/95; 404/77

[58] Field of Search ..... 404/77, 79, 95, 91, 404/90, 92; 126/271.2 A; 299/39

[56] References Cited

U.S. PATENT DOCUMENTS

| | | | |
|---|---|---|---|
| 3,778,110 | 12/1973 | Staab | 299/39 |
| 3,807,886 | 4/1974 | Cutler | 404/77 |
| 3,843,274 | 10/1974 | Gutman et al. | 404/91 |
| 3,970,404 | 7/1976 | Benedetti | 404/77 |
| 3,997,276 | 12/1976 | Jackson, Sr. | 404/77 |
| 4,129,398 | 12/1978 | Schoelkopf | 404/95 |
| 4,186,968 | 2/1980 | Barton | 404/90 X |
| 4,226,552 | 10/1980 | Moench | 404/92 |
| 4,335,975 | 6/1982 | Schoelkopf | 404/77 |
| 4,534,674 | 8/1985 | Cutler | 404/75 |
| 4,545,700 | 10/1985 | Yates | 404/75 |
| 4,711,600 | 12/1987 | Yates | 404/95 |

*Primary Examiner*—Jerome W. Massie
*Assistant Examiner*—Matthew Smith
*Attorney, Agent, or Firm*—Seed and Berry

[57] ABSTRACT

An asphaltic pavement preconditioning machine to remove and grind up old asphalt so that it can be rejuvenated. The method and apparatus heats a strip of asphalt, grinds a first strip portion and moves the ground asphalt to a second strip portion leaving behind an exposed unsoftened layer. Both the ground material and the previously heated unground asphalt in the second strip are then ground. The exposed hard asphalt in the first strip is heated, softened and then ground and moved onto the first strip portion. The heat from the ground asphalt lying over the center strip portion softens the unground asphalt there which is subsequently ground together with the ground material and left for further processing.

19 Claims, 2 Drawing Sheets

METHOD AND APPARATUS FOR PREPARING ASPHALTIC PAVEMENT FOR REPAVING

BACKGROUND

The present invention relates to a method and apparatus for removing old asphalt from a pavement surface and reconditioning it so that it is suitable for use in repaving.

It is well known that asphalt flows in response to applied pressure and in time oxidizes and develops bumps, ruts, cracks and other defects. Originally, grinders were used to break down the old asphaltic surface which was then picked up and transported by truck to a processing plant, reprocessed, and the reprocessed asphalt transported back and reapplied in a known way. More recently equipment has been developed to recycle the old asphalt on site. U.S. Pat. No. 3,843,274 issued Oct. 22, 1974 to Gutman et al., discloses a vehicle having an infra red heater to first heat the asphalt, a rotating cutter for lifting the heated asphalt up a ramp and a pugmill for pulverizing the lifted asphalt. Finally, a spreader screw distributes the pulverized asphalt across the road surface and a heating and vibrating means levels and compacts the asphalt. The limited heating capacity of Gutman et al combined with the low thermal conductivity of asphalt allows its cutter to cut through only a thin layer of asphalt unless it were to cut through unsoftened asphalt. Proper reconditioning of an asphalt surface requires that it strip at least 2 inches off of the old surface. Thus, miltiple passes are required with a machine such as that disclosed in Gutman et al.

U.S. Pat. No. 3,970,404 issued to Benedetti discloses a method of achieving a greater depth of penetration in the heating step by interrupting the heating steps with heat transfer steps in which radiant heat is not applied allowing heat to soak in and the surface temperature to lower. A greater depth of heating of the order of 1 inch or more is achieved.

U.S. Pat. No. 4,226,552 issued Oct. 7, 1980 to Moench discloses the use of 7 different vehicles to perform a series of treatments on old asphaltic pavement to render it suitable for reuse on site. First, the pavement is heated and then scarified to break it up into a loose aggregate asphalt mixture lying on a lower hard asphaltic surface. A second vehicle heats the broken up aggregate and underlying hard surface and then breaks up the pavement down to a further depth. The broken up asphalt is graded into a narrow row, picked up and heated, mixed with a reconditioning agent, pulverized and spread over the road surface. A major problem with Moench is the need to heat the hard asphalt with an overlying layer of broken up previously heated asphalt. Much of the radiant energy is absorbed by the overlying broken up layer and so transfer of radiant energy to the underlying unbroken asphalt is substantially reduced from what it would otherwise be without a covering of loose asphalt.

U.S. Pat. No. 4,335,975 issued to Schoelkopf on June 22, 1982 discloses a machine and method by which old pavement is heated, broken up by a tearing up beam or blade and ground into a grain type structure by two semi-worm blades and screeding and accumulation blades. Fresh asphalt is then poured over the softened broken up old asphalt and compacted. Since old asphalt loses ingredients such as resins on oxidation it is necessary to add these to old asphalt to replace the lost ingredients. It is also necessary to heat the old mixture so that these added resins resolublize the asphaltenes in the asphalt. The absence of heating, the addition of rejuvenants and pulverizing prior to reapplying the old asphalt to the road surface in the Schoelkopf process means the old asphalt is not adequately restored prior to reuse by that process. U.S. Pat. No. 4,534,674 issued on Aug. 13, 1985 to Cutter discloses a process similar to that of Schoelkopf.

U.S. Pat. No. 4,545,700 issued Oct. 8, 1985 to Yates discloses a process of sequentially heating and milling an asphalt road surface using lateral collection chutes to guide milled material to the rear of the machine. An additive is added prior to the last milling step and mixed in with the aggregate which is then reapplied. Yates uses a somewhat elaborate system of collection chutes to contain and guide removed material to the rear of the machine.

SUMMARY OF THE INVENTION

According to the invention there is provided an asphaltic pavement pre-conditioning machine for use in rejuvenating agent and reapplying it to a surface to be paved. The machine includes a first infra red heating means for heating an upper layer of a strip of asphalt to a more softened condition. A first strip portion of the heated asphalt is then ground by first grinding means and moved to an adjacent unground second strip of the asphalt to form a row thereon. Thus hard unheated asphalt is exposed in the first strip portion. A second grinding means is used for grinding the unground second strip portion and the moved material. A second infra red heating means is used for heating the unexposed unheated asphalt in the first strip portion behind the first grinding means to a more softened condition. A third grinding means grinds the softened asphalt in the first strip portion and moves it to the second strip portion wherein heat from the ground asphalt soaks into the unground asphalt. A fourth grinding means is used to grind the softened ashpalt in the second strip portion. By grinding and piling heated asphalt onto the second strip portion, heat from the latter is absorbed by the unground asphalt in the second strip portion, thereby obviating both the need to remove the ground material and the need to reheat the unground asphalt in the second strip portion. Advantageously the first and second infra red heating means includes a plurality of spaced apart banks of heaters with the first bank extending across the width of the strip and the second bank extending across only the exposed unheated ashalt in the first strip portion. The space. between banks is sufficient to allow the surface temperature of ashalt heated by the previous bank to lower sufficiently so that it dose not become overheated. Heaters may be provided at the ends of each space between the banks to compensate for the lower temperatures generated in the asphalt near the ends of each bank. Thus, the heaters so configured provide a heat soaking interval in between heating intervals during which time heat from the surface is conducted down into the interior of the asphalt thereby lowering the surface temperature and increasing the depth of heating. At the same time the provision of heaters near the ends of each space between the banks compensates for the lower effective radiant energy impinging on the edges of each bank of heaters.

Preferably the first grinding means grinds two side strip portions of the heated asphalt and moves the ground material to an unground center strip portion so that a subsequent bank of heaters may heat the underlying exposed hardened asphalt in the two side strip portions behind the first grinding means without the radiant energy being screened by the ground material removed by the first grinding means. Similarly, the third grinding means grinds the softened asphalt in the two side strip portions and moves it to the center strip portion in order to localize the ground material in a desired row location on the center strip portion.

According to another aspect of the invention there is provided a method of reconditioning asphalt pavement which includes heating a strip of asphaltic pavement until it is softened, grinding a first strip portion of the softened asphalt of the strip and moving the ground asphalt to an adjacent unground portion of the strip. The unground asphalt in the second strip portion of the strip is then ground. The first strip portion is heated and subsequently ground moving the ground material to the center strip portion. The unground asphalt in the second strip portion is ground following which the ground asphalt is mixed with rejuvenant and reapplied to the pavement.

Preferably the method includes grining two side strip portions of the strip and moving the ground aspahalt onto a center strip portion which separates the two side strip portions. The unground asphalt in the center strip portion is ground and the two side strip portions again heated to soften the asphalt therein. The softened asphalt is again ground in the two side strip portions and moved onto the center strip portion. Finally the unground asphalt in the center strip portion is ground and lift for further processing.

The further processing preferably includes mixing the ground asphalt in the center strip portion with rejuvenant, heating it, pulverizing it and then applying it to the pavement. Typically the time between moving ground asphalt onto the center strip portion and grinding it together with underlying unground asphalt is 3 to 5 minutes.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
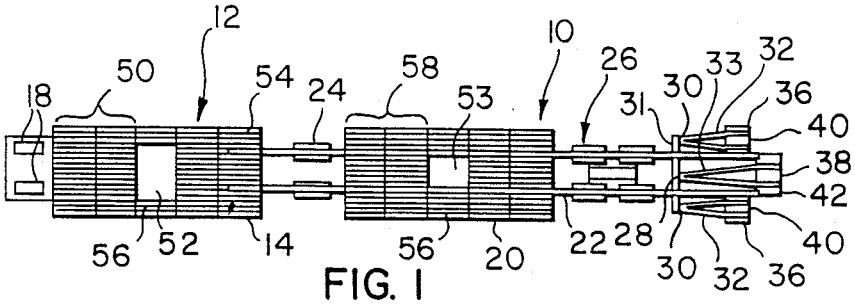
FIG. 1 is a plan view of the apparatus showing the layout of the banks of heating elements and grinders in relationship to the vehicles used to support them.

Referring to FIG. 1 there is shown in plan view a self propelled vehichle 10 and an attached trailer section 12 attached to the front of vehicle 10. Trailer 12 consists of a platform 16 supported by wheels 18 and 20 at either end thereof. Rows 14 of propane fired elongated infra red heaters 54 are arranged in side by side relationship to extend across a strip of pavement to be heated. Two of rows 14 make up a bank of heaters 50 with each bank 50 being separated by a space 52. At either end of space 52 there are located 3 elongated radiant heaters 56 designed to compensate for the lower heating effect at the edges of the banks of heater 54. Trailer 12 is coupled to the front end of trailer 10 and has a pair of steering wheels 18 which are remotely controlled through a micro processor unit (not shown) located at the rear of vehicle 10.

Vehicle 10 is made up of a frame or platform 22 supported by front wheels 24 and a rear pair of wheels 26. Rear wheels 26 and front wheels 24 can both be turned in response to remote control signals applied by an operator at the rear of vehicle 10. The grinding units for each vehicle 10 and 10*a* consist of a pair of front side grinders 36 supported by means of V brace members 32 supported at screw connections 30 from a front beam 31 affixed to the frame 22 of trailer 10. A rear grinder unit 38 is coupled to screw connection 28 by means of V brace 33. Rear grinder unit 38 overlaps slightly the interior edges of side grinders 36.

Figure 6:
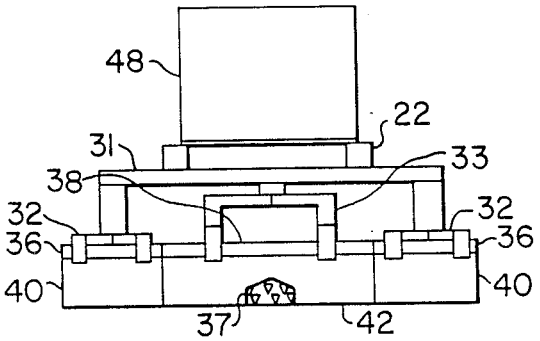
FIG. 6 is a rear elevation view of FIG. 2 or FIG. 4 showing the rear plates of the grinders.

At the back of grinders 36 and 38 there are vertically oriented blades 40 and 42 which extend down to the level of the cutting edges of grinders 36 and 38 and in operation exerts slight pressure on the freshly ground pavement surface. As seen in FIG. 6 there is an opening 37 in the center of blade 42 to permit ground material to pass therethrough.

The platform 22 of vehicle 10 is used to support a variety of different equipment required to operate the units such as a propane tank 44, a container 46 to hold rejuvenant and pump unit 48. Rows of heaters 20 are also suspended from platform 20 and are divided by space 53 into two banks 58.

Figure 2:
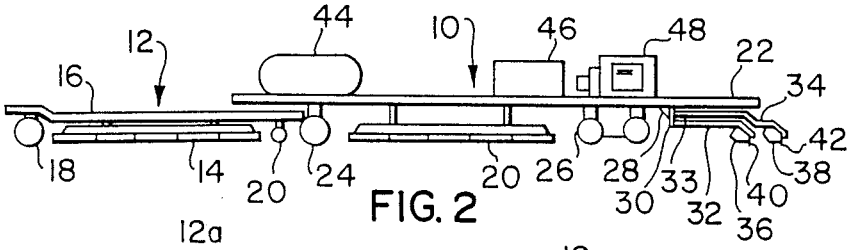
FIG. 2 is a side elevation view of the equipment shown in FIG. 1.
Figure 3:
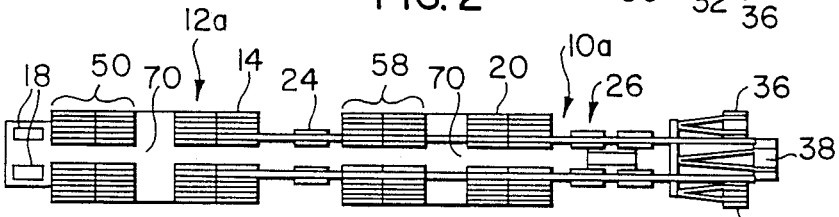
FIG. 3 is a plan view of a second vehicle adapted to be driven behind the first vehicle shown in FIG. 1.
Figure 4:
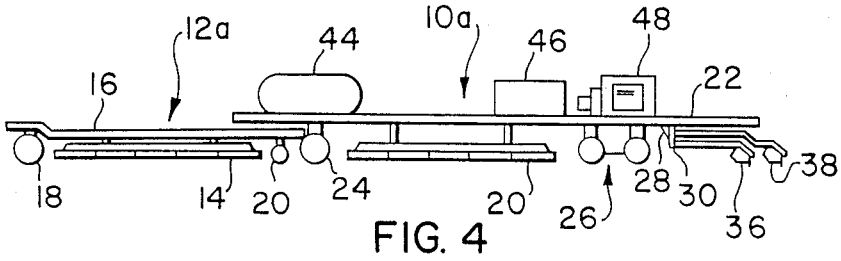
FIG. 4 is a side elevation view of the vehicle shown in FIG. 3.

Referring to FIGS. 3 and 4 there is shown a self propelled main vehicle 10*a* and trailer 12*a* identical in all respects to vehicles 10 and 12 shown in FIGS. 1 and 2 except that the banks of heater elements 50 and 58 are split by means of a gap 70 in each bank approximately 4 feet in width.

Figure 5:
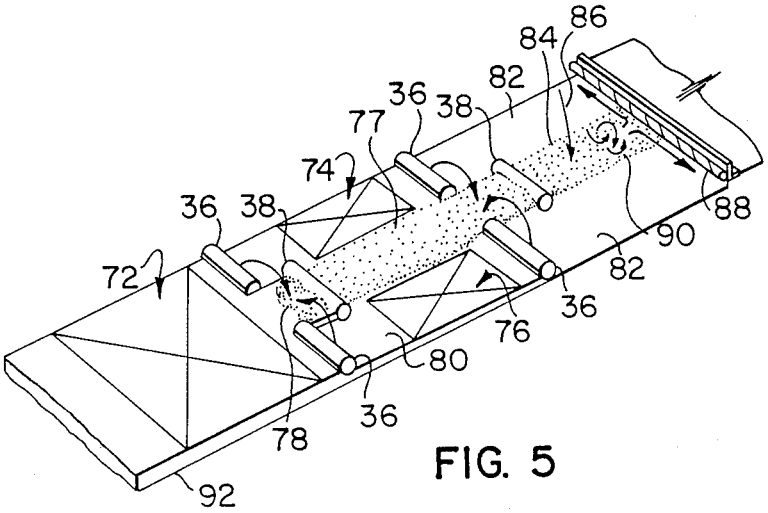
FIG. 5 is a schematic perspective diagram showing the material processing and flow accomplished by the two vehicles shown in FIGS. 1 to 4.

In operation vehicles 10 and 12 are followed closely behind by vehicles 10*a* and 12*a*. The way in which these vehicles process and move the material is illustrated in FIG. 5. In this case a strip of pavement 92 is initially heated over an area 72 with the vehicles in a given position. It is to be understood that the areas shown in FIG. 5 are only a snapshot of an on going process which progresses forwardly as the vehicles move. Grinders 36 grind the freshly heated asphalt 92 down to a first depth and simultaneously transport the ground material 78 onto a center strip 77 separating the two grinders 3l. Rear grinder 38 grinds both the previously ground material 78 and the unground center strip portion 77. The split heaters of vehicles 10*a* and 12*a* then heat the two strip portions 74 and 76 until they are softened. Subsequently, grinders 36 on vehicle 10*a* grind the two side strip portions 74 and 76 and simultaneously move the ground material onto the center strip portion 77. Grinder 38 of vehicle 10*a* grinds both the previously ground material and underlying unground material leaving the latter 84 behind. Rejuvenant is then added at step 86 to the ground material 84 which is then pulverized at step 90 by a pugmill mixer (not shown). The mix material can then be further processed either by leveling it out with a screed 88 and then compacting it or, by picking up the ground material and directing it to a bin in which the old material is heated, mixed and spread over the pavement surface by a repaving machine of conventional design (not shown). The speed of the machines and spacing of the grinders relative to the banks of heating elements is such that ground pavement is left on the top of the surface of the center strip 77 where it is allowed to soak into the underlying unground material for a period of three to five minutes. This period has been found sufficient to soften the unground underlying material sufficiently so that grinding of this material is facilitated.

It will be appreciated that there is no need to pick up any ground material and convey it along over subsequent heating elements and grinders as in conventional devices. The absence of any conveyors required for such purposes considerably reduces the capital cost and increases the reliability of the equipment. In addition, a greater energy efficiency is achieved by utilizing the heat stored in the ground material to soak in and soften unground material rather than relying on further radiant heating for this purpose.

It will be appreciated that the configuration of FIG. 5 is not the only one which can be used. It is for example possible to separate the strip 92 into only two strip portions. In this case, the first step would be an overall heating of strip such as in area 72 whereas the second step would involve using only two grinders with one spaced back from the other and the first grinder used to both grind one strip portion and move the ground material over to the other strip portion. However, utilizing two side strip grinders and leaving the ground material in the center strip portion makes it convenient for subsequent equipment to process the ground material.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall with the true scope of the invention.

I claim:

1. An asphaltic pavement pre-conditioning machine for use inconditioning old asphaltic pavement prior to mixing it with a rejuvenating agent and reapplying it to a surface to be repaved, comprising:

(a) first infra red heating means for heating an upper layer of a strip of asphalt to a more softened condition;

(b) first grinding means for grinding a first strip portion of said heated asphalt and moving ground asphalt to an adjacent unground heated second strip portion of said asphalt to form a row thereon exposing unheated asphalt in said first strip portion;

(c) second grinding means for grinding said unground heated second strip portion;

(d) second infra red heating means for heating the exposed unheated asphalt in said first strip portion behind said first grinding means to a more softened condition;

(e) third grinding means for grinding softened asphalt in said first strip portion and transporting it on to said second strip portion; and (f) fourth grinding means for grinding unground asphalt softened by heat from previously ground asphalt;

wherein said fourth grinding means is spaced apart from said second grinding means sufficiently far so that heat from asphalt ground by said second grinding means soaks down into the underlying unground asphalt to soften the latter prior to being ground by said fourth grinding means.

2. A machine according to claim 1, wherein said first infra red heating means includes a plurality of spaced apart banks of heaters, each bank extending across the width of said strip, and the space between banks being sufficient to allow heat to transfer into the asphalt interior and the surface temperature to lower sufficiently so that heating by the next bank keeps the temperature of the ashalt below a point where overheating damaging the asphalt occurs and including heaters at the ends of each space to compensate for the lower temperatures generated in the asphalt near the ends of each bank.

3. A machine according to claim 1, wherein said second infra red heating means includes a plurality of spaced apart banks of heaters, each bank extending across only the exposed unheated asphalt in said first strip portion and the space between banks being sufficient to allow the surface temperature of asphalt heated by a previous bank to lower sufficiently so that it does not become overheated.

4. An asphaltic pavement pre-conditioning machine for use in pre-conditioning old asphaltic pavement prior to mixing it with a rejuvenating agent and reapplying it to a surface to be repaved, comprising:

(a) first infra red heating means for heating an upper surface layer of a strip of asphalt to a more softened condition;

(b) first grinding means for grinding two side strip portions of said heated asphalt and moving the ground asphalt to an unground center strip portion;

(c) second grinding means for grinding said unground center strip portion;

(d) second infra red heating means for heating exposed asphalt in said side strip portions behind said first grinding means to a more softened condition;

(e) third grinding means for grinding softened asphalt in said side strip portions and moving it to said center strip portion; and (f) fourth grining means for grinding previously unground asphalt softened by heat from the ground asphalt in said center strip portion;

wherein said fourth grinding means is spaced apart from said second grinding means sufficiently far so that heat from asphalt ground by said second grinding means soaks down into the underlying unground asphalt to soften the latter prior to being ground by said fourth grinding means.

5. A machine according to claim 4, wherein said first and third grinding means both grinds asphalt and moves it towards the center strip portion.

6. A machine according to claim 4, wherein each of said grinders includes a rotating portion with a plurality of protruberances spaced over the surface thereof and a vertical blade immediately behind said rotating portion and supported by a common frame with said rotating portion, said vertical blade normally contacting the pavement.

7. A machine according to claim 6, wherein said fourth grinding means having a vertical blade with an opening centrally thereof sufficient to permit escape of the ground material in a row along said center strip portion.

8. A machine according to claim 4, wherein said first infra red heating means includes a plurality of spaced apart banks of heaters, with each bank extending across the width of said strip and the space between banks being great enough to allow the surface temperature of asphalt heated by a previous bank to drop sufficiently so that it avoids overheating upon being heated by a next bank of heaters.

9. A machine according to claim 8, wherein said second infra red heating means includes a plurality of spaced apart banks of heaters, each bank extending across only exposed unheated asphalt in said first strip portion and the space between banks being sufficient to allow the surface temperature of asphalt heated by a previous bank to lower sufficiently so that it does not overheat during exposure to a subsequent bank of heaters wherein asphalt in said center strip portion is heated by ground asphalt deposited thereon.

10. A machine according to claim 6, wherein said second and fourth grinding means overlaps with ends of said first and third grinding means so as to cover, together the width of said strip.

11. A machine according to claim 8, including heating sections on either end of the space between banks to compensate for the reduced heating effect at the end of said banks of heaters.

12. A method of reconditioning asphaltic pavement comprising:

heating a strip of asphaltic pavement until it is softened;

grinding a first strip portion of softened asphalt of said strip;

moving the ground asphalt to an adjacent unground strip portion of said strip;

grinding unground asphalt of said adjacent strip portion;

heating exposed unheated asphalt in said first strip until it is softened;

grinding softened asphalt in said first strip portion and moving it onto said adjacent strip portion;

grinding previously unground asphalt in said adjacent strip portion at a time after the second grinding step sufficiently long so that heat from said ground previously heated asphalt soaks into underlying unground asphlat and softens it sufficiently to be ground; and mixing said ground asphalt with rejuvenant and reapplying it to the pavement.

13. A method according to claim 12, wherein said heating steps include exposing a section of said asphaltic strip to successive spaced apart banks of infra red heaters until it becomes softened.

14. A method of preparing asphaltic pavement for repaving, comprising:

heating a strip of asphaltic pavement until it is softened;

grinding two side strip portions of said strip and moving the ground asphalt onto an unground center strip portion separating said side strip portions;

grinding previously unground asphalt of said center strip portion in said center strip portion;

grinding softened asphalt in said two side strip portions and moving it onto said center strip portion; and grinding previously unground asphalt in said center strip at a time after the second grinding step sufficiently long so that heat from said ground previously heated asphalt soaks into underlying unground asphalt and softens it sufficiently to be ground.

15. A method according to claim 14, further including mixing said ground asphalt in said center strip with a reconditioning agent, heating it, pulverizing and spreading and compacting it over said strip.

16. A method according to claim 14, wherein said grinding and moving steps are done simultaneously.

17. A method according to claim 14, wherein the time between moving ground asphalt onto the center strip portion and grinding it together with underlying unground aspahalt is 3 to 5 minutes.

18. A method according to claim 14, wherein said heating steps include providing a heat soaking in period between applications of radiant heating so that the asphalt surface does not overheat.

19. A method according to claim 18, including heating end sections of said strip between said heating step to compensate for reduced heating effect at the ends.

* * * * *

UNITED STATES PATENT AND TRADEMARK OFFICE

CERTIFICATE OF CORRECTION

PATENT NO. : 4,850,740

DATED : July 25, 1989

INVENTOR(S) : Patrick C. Wiley

It is certified that error appears in the above-identified patent and that said Letters Patent is hereby corrected as shown below:

In claim 1, column 5, line 46, delete "inconditioning" and substitute therefor --in conditioning--.

In claim 4, column 6, line 45, delete "grining" and substitute therefor --grinding--.

In claim 14, column 8, line 17, following "center strip portion;" insert as a new paragraph --heating asphalt in said side strips exposed by said grinding step until it is softened;--.

Signed and Sealed this

Fifth Day of June, 1990

*Attest:*

HARRY F. MANBECK, JR.

*Attesting Officer*

*Commissioner of Patents and Trademarks*